United States Patent [19]

Kondo et al.

[11] 4,167,396

[45] Sep. 11, 1979

[54] AIR-TO-FUEL RATIO FEEDBACK CONTROL SYSTEM WITH IMPROVED TRANSITIONS BETWEEN OPENING AND CLOSING OF FEEDBACK CONTROL LOOP

[75] Inventors: Toshio Kondo, Anjo; Nobuyuki Ito, Hekinan; Hideaki Norimatsu, Kariya; Nobuyuki Kobayashi, Toyota, all of Japan

[73] Assignees: Nippondenso Co., Ltd., Kariya; Toyota Jidosha Kogyo Kabushiki Kaisha, Toyota, both of Japan

[21] Appl. No.: 831,290

[22] Filed: Sep. 7, 1977

[30] Foreign Application Priority Data

Sep. 23, 1976 [JP] Japan ..... 51/114212

[51] Int. Cl.[2] ..... F02B 3/00; F02B 75/10

[52] U.S. Cl. ..... 123/32 EE; 60/276; 60/285

[58] Field of Search ..... 123/32 EE, 119 EC, 32 EA; 60/276, 285

[56] References Cited

U.S. PATENT DOCUMENTS

| | | | |
|---|---|---|---|
| 3,916,848 | 11/1975 | Schmidt | 123/32 EE |
| 3,938,479 | 2/1976 | Oberstadt | 123/32 EE |
| 3,939,654 | 2/1976 | Creps | 60/285 |
| 3,949,551 | 4/1976 | Eichler et al. | 123/32 EE |
| 3,973,529 | 8/1976 | Wessel et al. | 123/32 EE |
| 3,986,352 | 10/1976 | Casey | 60/285 |
| 3,990,411 | 11/1976 | Oberstadt et al. | 123/32 EA |
| 4,015,428 | 4/1977 | Kawai | 60/285 |
| 4,027,477 | 6/1977 | Storey | 123/32 EE |

FOREIGN PATENT DOCUMENTS

| | | | |
|---|---|---|---|
| 2658613 | 7/1977 | Fed. Rep. of Germany | 123/32 EE |

*Primary Examiner*—Charles J. Myhre
*Assistant Examiner*—P. S. Lall
*Attorney, Agent, or Firm*—Cushman, Darby & Cushman

[57] ABSTRACT

In an air-to-fuel ratio feedback control system of the type in which the output detection signal of an air-to-fuel ratio detector adapted to detect the concentration of an exhaust gas constituent of an internal combustion engine is compared with a preset value in a comparison circuit whose output signal in turn is utilized to feedback control the air-to-fuel ratio of mixture supplied to the engine, the preset value of the comparison circuit is changed to another value in response to the occurrence of a condition which requires the stopping of the feedback control of the air-to-fuel ratio of mixture supplied to the engine, thereby preventing the occurrence of malfunction during transient periods such as the periods of opening and closing of the feedback control system loop.

4 Claims, 2 Drawing Figures

AIR-TO-FUEL RATIO FEEDBACK CONTROL SYSTEM WITH IMPROVED TRANSITIONS BETWEEN OPENING AND CLOSING OF FEEDBACK CONTROL LOOP

BACKGROUND OF THE INVENTION

1. Field of the Invention

The present invention relates to an air-to-fuel ratio feedback control system wherein the concentration of a constituent in the exhaust gases from an internal combustion engine is detected to thereby control the air-to-fuel ratio of mixture drawn into the engine.

2. Description of the Prior Art

It is known in the art to provide in the exhaust pipe of an internal combustion engine an air-to-fuel ratio detector to detect the concentration of oxygen in the engine exhaust gases and generate a detection signal whose output level changes at the stoichiometric air-to-fuel ratio, whereby a comparison circuit compares the detection signal with a predetermined reference value corresponding to the stoichiometric air-to-fuel ratio to determine whether the mixture supplied to the engine is richer or leaner than the stoichiometry and thereby feedback control the air-to-fuel ratio of the mixture supplied to the engine in accordance with the output signal of the comparison circuit. Another feedback control system of this type is also known in the art in which when there exists a feedback control stopping condition, such as, when the temperature of an engine is low as during starting periods of the engine or an air-to-fuel ratio detector is rendered inactive (inoperative) so that its output signal remains at a high voltage level as would be the case when the air-to-fuel ratio detector has detected that the air-to-fuel ratio is richer, the feedback control system for the air-to-fuel ratio is switched from the closed loop to an open loop to thereby stop the feedback control. A disadvantage of this control method is that since the fact that the output signal of the air-to-fuel ratio detector has been remaining higher than a preset value of the comparison circuit is detected as a criterion for determining the necessity to effect switching between the open and closed loops of the feedback control system and since this preset value of the comparison circuit is the same with the preset value for determining whether the air-to-fuel ratio is rich or lean during the closed loop control, during transient periods such as during periods of transition from the open loop to the closed loop or from the closed loop to the open loop, there is the danger of the feedback control loop being intermittently switched from the open loop to the closed loop and vice versa by electrical noise induced on the output signal of the air-to-fuel ratio detector.

SUMMARY OF THE INVENTION

With a view to overcoming the foregoing deficiencies, it is the object of the present invention to provide an air-to-fuel ratio feedback control system wherein the detection signal from an air-to-fuel ratio detector adapted to detect the concentration of a constituent of the exhaust gases from an internal combustion engine is compared with a preset value to determine the air-to-fuel ratio and thereby to feedback control the air-to-fuel ratio of the mixture drawn into the engine, and when a condition occurs which requires the stopping of the feedback control the preset value is changed to a value lower than that used during the feedback control thus preventing the occurrence of malfunction of the air-to-fuel ratio feedback control system during periods of transition from the open loop to the closed loop and vice versa and thereby smoothly controlling the operation of the system during such transient periods.

DESCRIPTION OF THE PREFERRED EMBODIMENT

The present invention will now be described in greater detail with reference to the illustrated embodiment.

Figure 1:
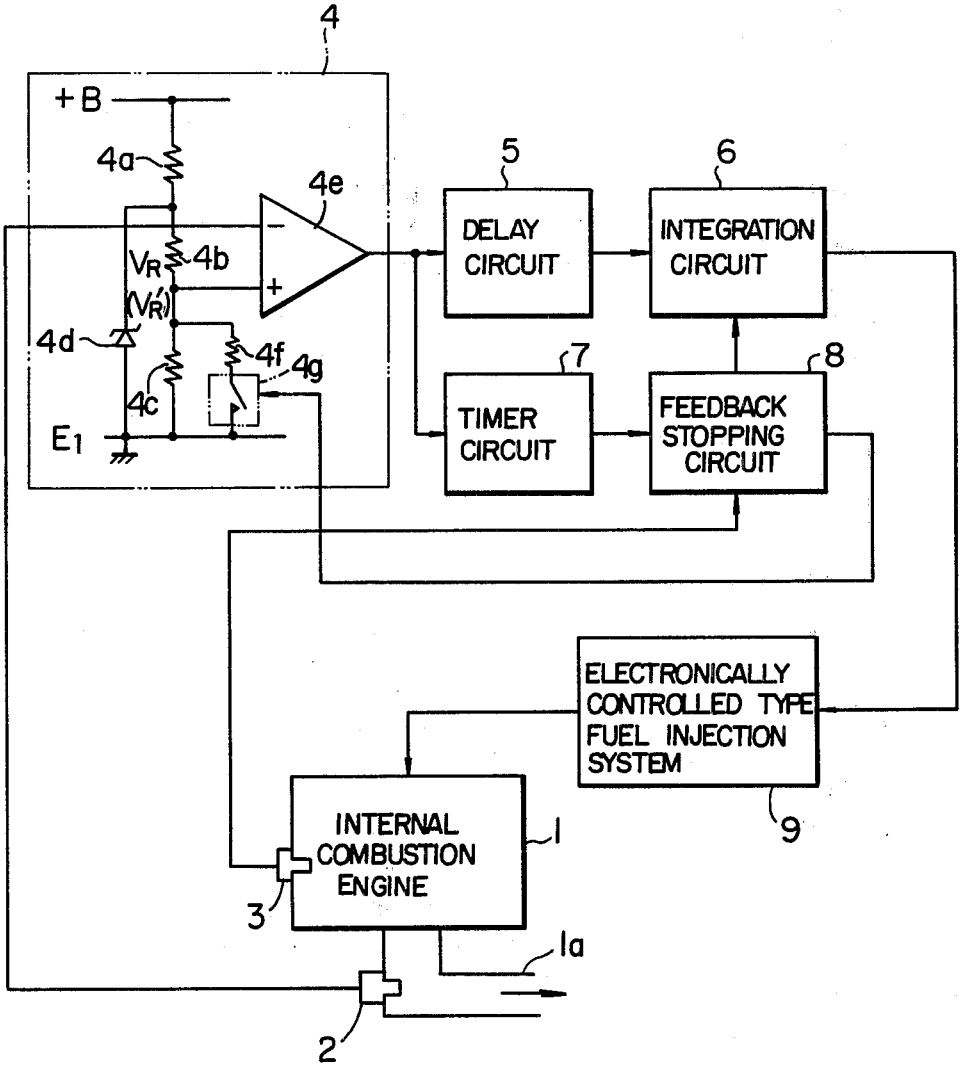
FIG. 1 is a block diagram showing the general construction of an embodiment of an air-to-fuel ratio feedback control system according to the present invention.

Referring to FIG. 1 illustrating a block diagram of an embodiment of the invention, numeral 1 designates an internal combustion engine mounted on an automobile and having disposed in its exhaust pipe la an air-to-fuel ratio detector 2 for detecting the air-to-fuel ratio in accordance with the oxygen concentration in the exhaust gas composition. Also disposed in the engine 1 is an engine temperature detector 3 for detecting the cooling water temperature. Numeral 4 designates a comparison circuit for comparing the detection signal from the air-to-fuel ratio detector 2 with a preset value $V_R$ corresponding to the stoichiometric air-to-fuel ratio to thereby determine the air-to-fuel ratio, 4*a*, 4*b* and 4*c* voltage dividing resistors for determining the preset value $V_R$, 4*d* Zener diode for stabilizing the preset value $V_R$, 4*e* a comparator for comparing the preset value $V_R$ with the detection signal from the air-to-fuel ratio detector 2, 4*f* and 4*g* a resistor and a switching device for changing the preset value $V_R$ to a lower value ($V_R'$) upon a request to change, whereby a lower level output indicative of the rich air-to-fuel ratio is generated when the detection signal from the air-to-fuel ratio detector 2 is higher than the preset value, and a high level output signal indicative of the lean air-to-fuel ratio is generated when the detection signal is lower than the preset value. Numeral 5 designates a delay circuit for delaying the output signal of the comparison circuit 4 to control the air-to-fuel ratio at a value slightly deviated from the stoichiometric ratio, 6 an integration circuit for integrating the delay signal from the delay circuit 5 in an increasing or decreasing direction depending on the level of the delay signal, 7 a timer circuit for detecting that the output signal of the comparison circuit 4 has remained at the low level for a predetermined time and thereby detecting that the air-to-fuel ratio detector 2 is in an inactive condition. Numeral 8 designates a feedback stopping circuit whereby when the timer circuit 7 generates an inactivity detection signal or the low engine temperature during the starting period of the engine 1 is determined in accordance with the detection signal from the engine temperature detector 3, that is, when a condition occurs which requires the stopping of the feedback control, a stop signal is generated to clear the integration value of the integration circuit 6. Also, in response to the stop signal from the feedback stopping circuit 8, the switching device 4*g* of the comparison circuit 4 is closed to change its preset value $V_R$ to the lower value $V_R'$. Numeral 9 designates a known electronically controlled type fuel injection system for electronically computing various operating conditions of the engine 1 to control the supply of fuel to the engine, whereby the fuel supply is corrected in accordance with the integration value of the integration circuit 6 to control the air-to-fuel ratio of the mixture supplied at a constant value. The individual circuits shown in block form in FIG. 1 are disclosed in detail, for example, in a U.S. patent application filed on Nov. 15, 1976 (Ser. No. 742,120), and therefore they will not be described in detail here.

Figure 2:
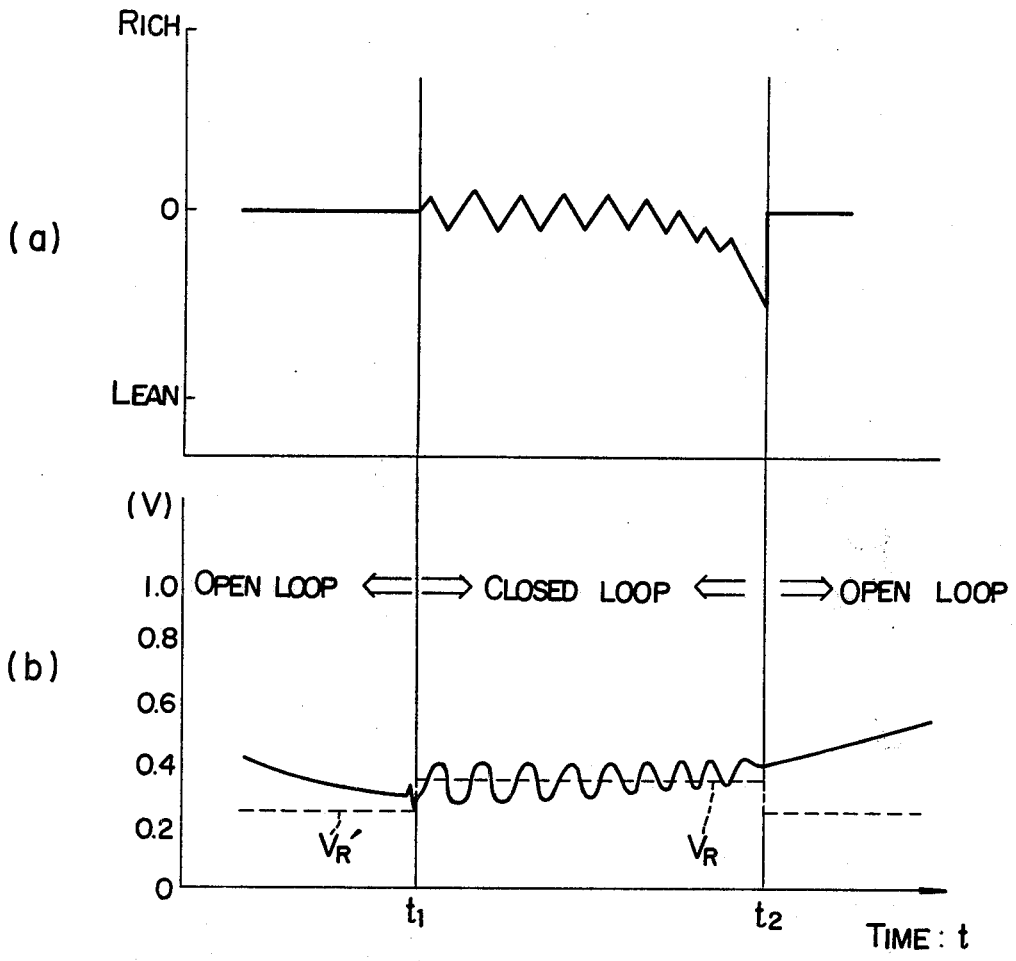
FIG. 2 is a characteristic diagram useful in explaining the operation of the system according to the invention.

With the construction described above, the operation of the embodiment will now be described with reference to the characteristic diagram of FIG. 2. In the Figure, (a) shows the amount of air-to-fuel ratio control signal, (b) shows the detection signal from the air-to-fuel ratio detector 2, and the broken lines indicate the preset values $V_R$ and $V_R'$. In the first place, during the starting period of the engine 1 before a time $t_1$, the exhaust gas temperature is low so that the air-to-fuel ratio detector 2 is rendered inactive and its detection signal has a high voltage. Thus, in response to the detection signal from the engine temperature detector 3 and the inactivity detection signal from the timer circuit 7, the feedback stopping circuit 8 generates a stop signal so that the integration value of the integration circuit 6 is controlled at zero and the feedback control system for the air-to-fuel ratio is changed to an open loop. Consequently, the engine 1 operates with the fuel supplied from the electronically controlled fuel injection system 9 without being subjected to the action of the feedback control system for the air-to-fuel ratio. In this case, the switching device 4g of the comparison circuit 4 is closed by the stop signal from the feedback stopping circuit 8, thus setting its preset value $V_R$ to the lower value $V_R'$ of 0.25 volts. As a result, even if the detection signal of the air-to-fuel ratio detector 2 momentarily becomes lower than the preset value $R_R$, so long as the detector signal remains higher than the preset value $V_R'$, the output signal of the comparison circuit 4 does not change its level, thus stably maintaining the feedback stopping condition.

Thereafter, when, at the time $t_1$, the detection signal from the engine temperature detector 3 is changed by the rise in the engine temperature so that the feedback control stopping condition due to the engine temperature is terminated and also the detection signal from the air-to-fuel ratio detector 2 once becomes lower than the feedback stopping preset value of 0.25 volts, thus causing the output signal of the comparison circuit 4 to change from the low level to the high level. Thus, the detection signal from the timer circuit 7 is terminated and also the detection signal from the feedback stopping circuit 8 is terminated, thus opening the switching device 4g of the comparison circuit 4 to cancel the feedback stopping preset voltage $V_R'$ of 0.25 volts and change the preset value to the value $V_R$ of 0.35 volts. As a result, the feedback control system for the air-to-fuel ratio is switched to the closed loop so that the output of the comparison circuit 4 is applied to the integration circuit 6 through the delay circuit 5 and the integration circuit 6 comes into integration operation. Thus, in response to the resulting integration value whose direction of increase and decrease changes each time the output level of the comparison circuit 4 changes stage, the fuel supply from the electronically controlled type fuel injection system 9 is corrected to control the air-to-fuel ratio of the mixture drawn into the engine 1 at a constant value which is slightly deviated from the stoichiometric ratio. Of course, if, in FIG. 1, the delay circuit 5 is eliminated and the output signal of the comparison circuir 4 is directly applied to the integration circuit 6, the air-to-fuel ratio of the mixture drawn into the engine will be controlled at the stoichiometric ratio.

Thereafter, when the detection signal from the air-to-fuel ratio detector 2 is caused by some reason or other to remain higher than the feedback preset value, 0.35 volts, of the comparison circuit 4 from a time $t_2$ and on, the output level of the comparison circuit 4 remains at the low level so that when the duration of this low level output signal reaches a predetermined time, the timer circuit 7 generates a detection signal and consequently the feedback stopping circuit 8 applies a stop signal to the integration circuit 6 thus forcibly reducing its integration value to zero. When this occurs, the feedback control system for the air-to-fuel ratio is switched from the closed loop to the open loop. At the same time, the switching device 4g of the comparison circuit 4 is closed by the stop signal and then the feedback preset value is changed from the value $V_R$ of 0.35 volts to the value $V_R'$ of 0.25 volts, thus preventing the occurrence of intermittent transition from the open loop to the closed loop and vice versa due to the introduction of electrical noise into the detection signal from the air-to-fuel ratio detector 2 and thereby stably controlling the operation of the system during transient periods.

With the above-described embodiment, it is possible to add, as disclosed in the previously mentioned patent application (Ser. No. 742,120), holding means which holds the just previously attained integration value of the integration circuit 6 during the time that the idle operation is being detected, and by arranging so that the switch device 4g of the comparison circuit 4 is simultaneously closed a that time, it is possible to stabilize the feedback control when the engine comes into an acceleration operation.

What is claimed is:

1. An air-to-fuel ratio feedback control system for internal combustion engines comprising:

detection means for detecting the air-to-fuel ratio of a mixture supplied to an engine in response to oxygen concentration in exhaust gases of the engine to produce a signal representing the air-to-fuel ratio thereof;

comparison means for comparing the air-to-fuel ratio representing signal of said detection means with a reference value preset to correspond to the stoichiometric air-to-fuel ratio;

correction means for correcting the air-to-fuel ratio of mixture which is to be supplied to said engine in response to the output value of said comparison means; and control means connected to said comparison means and said correction means for producing an output signal where an output level of said comparison means is kept unchanged during a predetermined period of time, the output signal of said control means preventing the correcting operation of said correction means;

said comparison means including means, connected to said control means, for varying, in response to the output signal of said control means, the reference value of said comparison means to a predetermined level which increases the difference from the air-to-fuel ratio representing signal of said detector means.

2. A control system according to claim 1, wherein said comparison means includes:

a resistor for establishing a constant level voltage at the junction thereof as said reference value;

a comparator connected to receive said constant level voltage and the output voltage of said detection means for comparing two voltages; and a switch controllable by the output signal of said control means for decreasing said constant level voltage by either opening or closing.

3. A control system according to claim 2, wherein said correction means includes:

an integration circuit connected to said comparator of said comparison means for integrating the output voltage of said comparator, said integration circuit being further connected to said control means for stopping the integration operation in response to the output signal of said control means; and fuel controller connected to said integration circuit for controlling the amount of fuel in the mixture which is supplied to said engine in response to the output voltage of said integration circuit.

4. A control system according to claim 1, wherein said comparison means includes:

a Zener diode for producing a stabilized electrical voltage;

a pair of resistors connected in series with each other and connected parallel to said Zener diode;

a comparator connected to receive the voltage at the junction point of said pair of resistors, and the output voltage of said detection means for comparing said two voltages;

a set of a switch and another resistor connected in series with each other, and connected parallel to one of said pair of resistors;

said switch being controllable by the output signal of said control means for decreasing said electrical voltage at the junction point of said pair of resistors.

* * * * *